United States Patent [19]

Webster

[11] Patent Number: 4,797,026

[45] Date of Patent: Jan. 10, 1989

[54] EXPANDABLE SAND-GRID FOR STABILIZING AN UNDERSURFACE

[75] Inventor: Steve L. Webster, Vicksburg, Miss.

[73] Assignee: The United States of America as represented by the Secretary of the Army, Washington, D.C.

[21] Appl. No.: 889,025

[22] Filed: Jul. 24, 1986

Related U.S. Application Data

[63] Continuation of Ser. No. 608,629, May 9, 1984, abandoned.

[51] Int. Cl.[4] ..... E01C 5/20

[52] U.S. Cl. ..... 404/28; 404/31; 404/73; 404/35; 428/117; 428/155

[58] Field of Search ..... 404/36, 31, 18, 28, 404/35, 70, 71, 73, 134; 52/671, 600, 670; 428/117, 155; 405/258

[56] References Cited

U.S. PATENT DOCUMENTS

| | | | |
|---|---|---|---|
| 181,392 | 8/1876 | Baird | 404/70 |
| 533,498 | 2/1895 | Rowell | 404/134 |
| 1,704,608 | 3/1929 | Humphris | 52/671 |
| 1,976,395 | 10/1934 | Herbest, Jr. | 52/670 X |
| 1,982,109 | 11/1934 | Keown | 404/134 |
| 1,982,110 | 11/1934 | Keown | 404/70 X |
| 1,983,412 | 12/1934 | Smith | 52/670 |
| 2,329,678 | 9/1943 | Pennington | 52/671 X |
| 2,404,097 | 7/1946 | Ruppel | 404/36 |
| 2,912,910 | 11/1959 | Wilson et al. | 404/36 |
| 3,109,350 | 11/1963 | Wilson | 404/100 |
| 3,338,014 | 8/1967 | Waite | 404/36 X |
| 3,630,813 | 12/1971 | Allen | 428/117 X |
| 3,925,994 | 12/1975 | Broms et al. | 404/31 X |

*Primary Examiner*—Jerome W. Massie
*Assistant Examiner*—Matthew Smith
*Attorney, Agent, or Firm*—Charles Calkins; Darrell Hollis

[57] ABSTRACT

A grid system for stabilizing an underlayer and providing a support surface includes 60 longitudinally extending polyethylene strips which are bonded one to another in an offset manner and are adapted for providing a grid. The grid has a first collapsed orientation wherein the strips are generally linearly aligned and substantially contiguous and a second expanded orientation wherein the strips are generally longitudinally sinusoidal for providing a plurality of cells. The cells are filled with compacted naturally occurring beach sand. An asphalt layer is applied to the upper surface of the grid and penetrates the cells to a predetermined depth for thereby providing a roadway surface adapted for vehicler traffic.

59 Claims, 2 Drawing Sheets

FIG 1
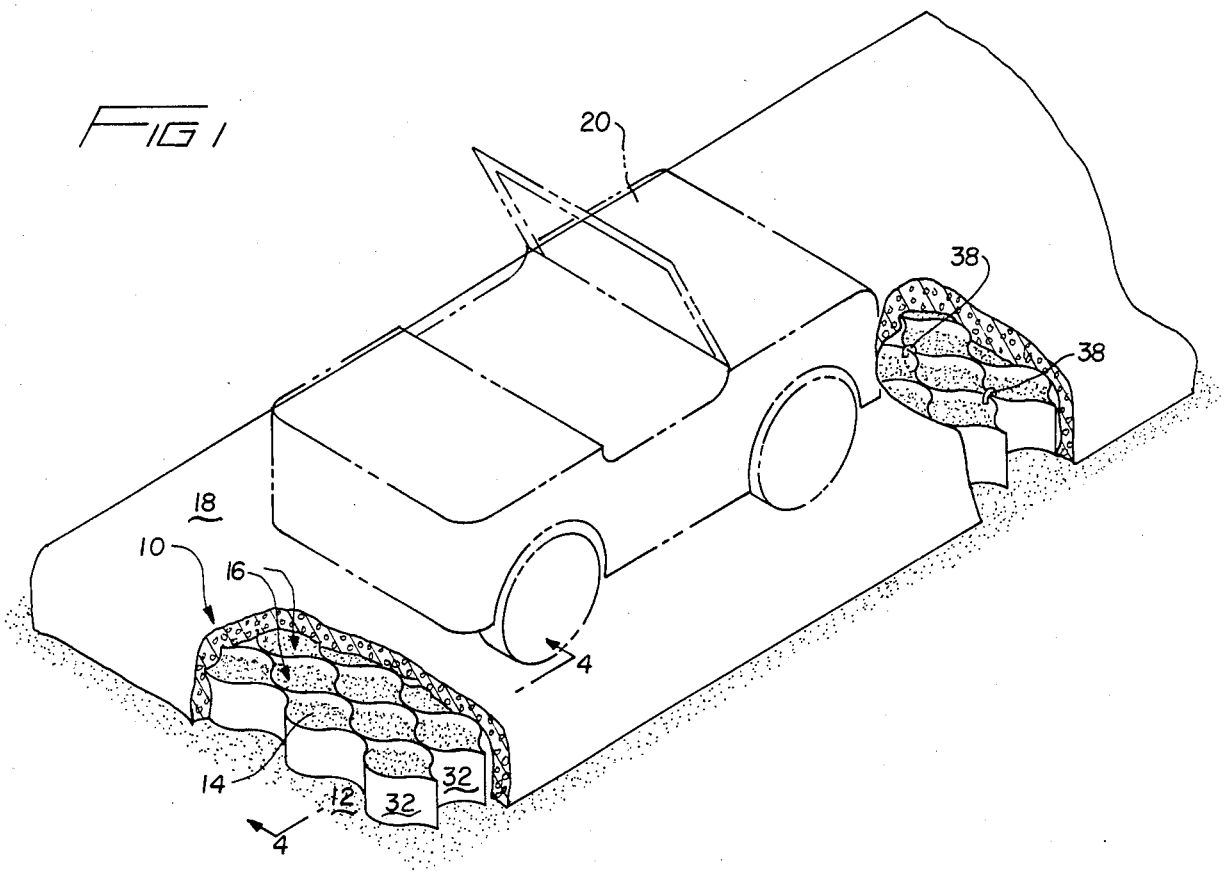
FIG 2
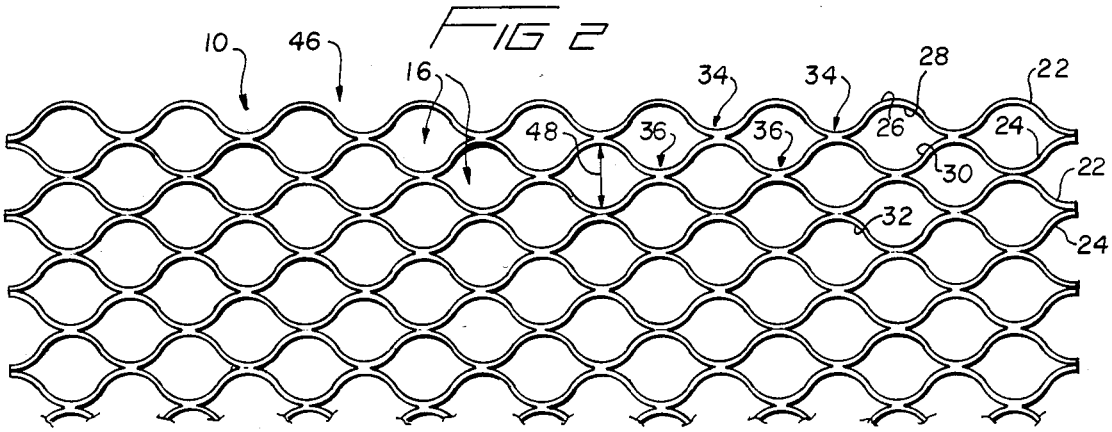
FIG 3
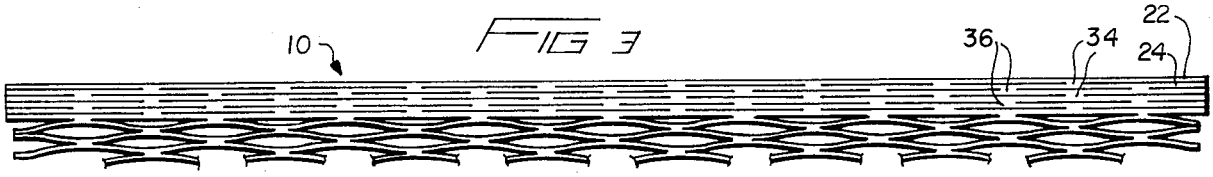
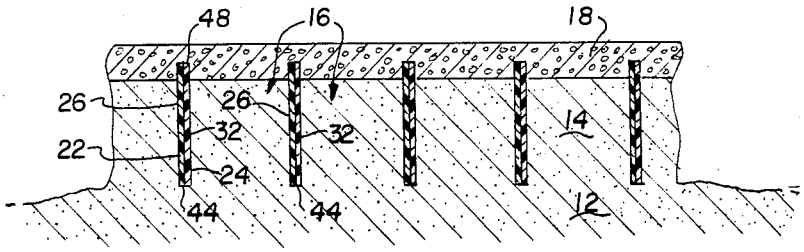
FIG 4

EXPANDABLE SAND-GRID FOR STABILIZING AN UNDERSURFACE

This is a continuation of application Ser. No. 608,629 filed May 9, 1984, abandoned.

BACKGROUND OF THE INVENTION

It is frequently necessary that vehicles, particularly heavy vehicles such as tractor trailers, travel over terrain which is relatively unstable and unable to adequately support the vehicle. Such terrain is frequently encountered in beach areas, particularly the area between the low tide line and the high tide zone. Additionally, unstable terrain is also encountered for many miles inland of the high tide zone. The instability of the terrain is generally due to the presence of sand. While sand, as well as other aggregates, has long been used in the construction of concrete roadways, such construction frequently requires that the sand be graded. Additionally, binders or mortar are also required. Consequently, the construction of a roadway from naturally occurring beach sand has been effectively prevented due to the high cost of transporting and preparing the raw materials. Consequently, the utilization of naturally occurring beach sand without the necessity for binders would be advantageous.

Wilson, et al, U.S. Pat. No. 2,912,910, discloses a beach landing mat in which a plurality of longitudinally spaced parallel members are arrayed in a grid adapted for penetrating the naturally occurring beach sand. Each of the longitudinal members is connected to adjacent members by a plurality of spaced parallel transverse members. The longitudinal and transverse members are each comprised of a thin metal, the structural strength of which is insufficient to support the vehicle. The beach landing mat of Wilson is, however, disadvantageous because of the weight of the members as well as the rather difficult assembly which is required.

Ruppel, U.S. Pat. No. 2,404,097, discloses an expandable ground mat comprised of a plurality of interlocking metal members. The mat of Ruppel is adapted for self-opening upon impact with the ground after the mat is dropped from an airplane. The Ruppel ground mat is a rather complicated mechanism and the assembly thereof is rather difficult. Furthermore, the mat is relatively heavy and occupies a relatively large amount of space.

Mascaro, U.S. Pat. No. 4,111,585, discloses a module and modular support for turf grass areas. The modules of Mascaro are made of a plastic material, such as high density polyethylene. The modules are interconnected and have a bottom surface adapted for being supported on an underlayer. The modules may be filled with sand or soil. The Mascaro modules are, however, rather tedious to assemble and the shipping volume of each is excessive.

The present invention discloses and claims a new and unique expandable grid system which has a first collapsed, orientation of relatively small volume and a second expanded orientation having a plurality of upstanding open-ended cells. The grid is comprised of a plurality of interconnected strips of resilient material, preferably polyethylene, which are bonded to each other in an offset relationship to thereby provide a plurality of double-belled cells. The cells may be advantageously filled with naturally occurring beach sand or other aggregates for thereby stabilizing an underlayer while also supporting the grid system. A plurality of the grids may be stacked one upon the other for building walls or revetments. Additionally, the grid may have an asphalt coating applied to the upper surface thereof in order to provide a roadway. Preferably, the asphalt penetrates approximately the top one-half to one inch of the sand filled cells and thereby permits vehicles of up to 53,000 pounds to travel thereon. Consequently, the present invention provides a new and unique expandable grid system which is readily transportable, easily erected, and which permits traffic thereon by heavy equipment.

OBJECTS AND SUMMARY OF THE INVENTION

The present invention involves an expandable sand grid system which permits the advantageous utilization of naturally occurring beach sand and other ungraded aggregates. A plurality of high density polyethylene strips are interconnected through sonic welding in an offset relationship for providing a plurality of open ended cells when the grid is expanded. The sand grid system preferably comprises 60 polyethylene strips having a height of approximately 6 to 8 inches and a length of approximately 132 inches. The sand grid system weighs approximately 105 pounds and can be collapsed to a thickness of approximately 3.5 inches. The sand grid system may be readily erected without the need for significant amounts of mechanized equipment.

A primary object of the disclosed invention is to provide a sand grid system which is relatively simple to manufacture and which overcomes the disadvantages of the prior art systems.

Another object of the disclosed invention is to provide a sand grid system which may be utilized to build walls or revetments as well as roadways.

Still another object of the disclosed invention is to provide a sand grid system which is easily cut to size and which follows the natural contour and direction of the terrain.

Yet a further object of the disclosed invention is to provide a sand grid system which is lightweight and which occupies a relatively small volume during shipment.

Yet still a further object of the disclosed ivention is to provide a sand grid system which utilizes conventional hardenable materials for providing a roadway which may be utilized by heavy vehicles.

Yet another object of the disclosed invention is to provide a sand grid system which supports the naturally occurring terrain.

Yet still a further object of the disclosed invention is to provide a method for erecting a sand grid system.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a fragmentary perspective view with portions broken away of my sand grid system and with a vehicle shown in phantom lines;

FIG. 2 is a top plan view of the sand grid in the expanded orientation;

FIG. 3 is a top plan view of the sand grid partially in the collapsed orientation and in the process of being displaced to the expanded orientation;

FIG. 4 is a fragmentary cross-sectional view taken along the section 4—4 of FIG. 1 and viewed in the direction of the arrows;

DESCRIPTION OF THE INVENTION

Figure 5:
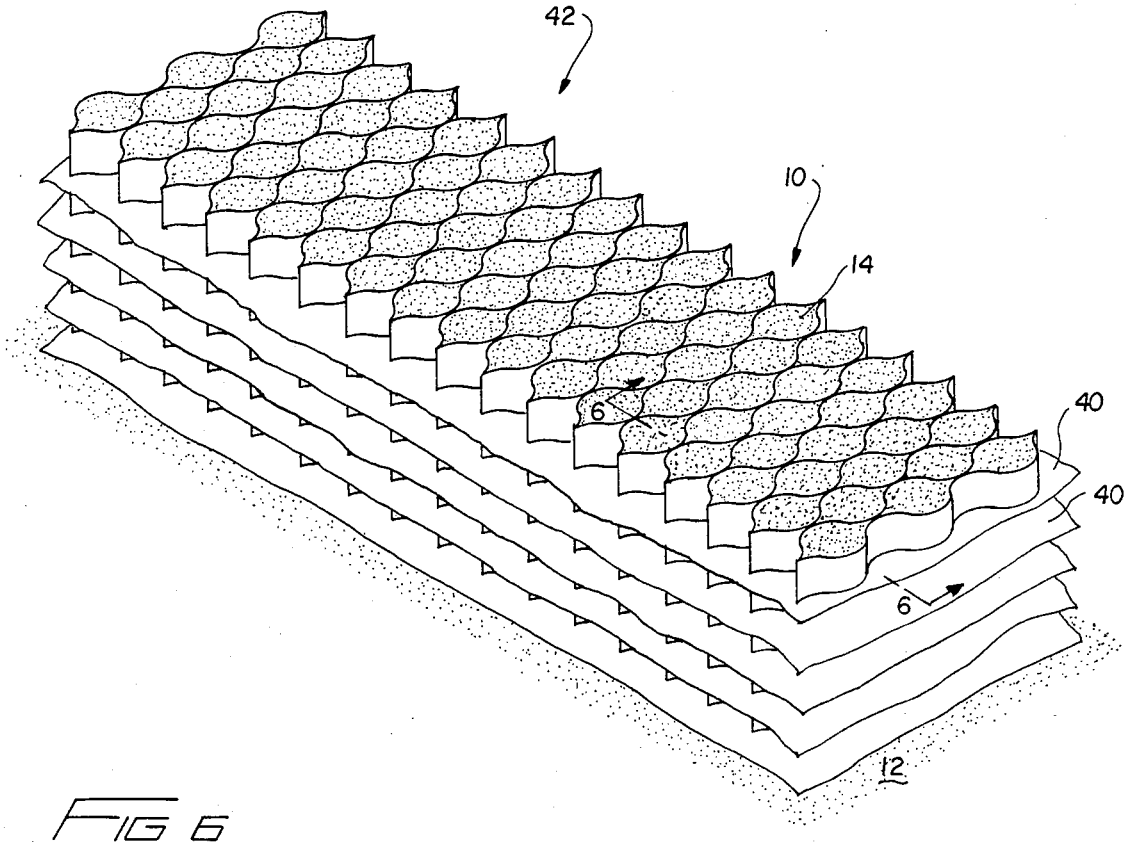
FIG. 5 is a perspective view of a revetment comprised of a plurality of sand grids with a barrier disposed between the grids; and, FIG. 6 is a fragmentary cross-sectional view taken along the section 6—6 of FIG. 5 and viewed in the direction of the arrows.

A sand grid 10, as best shown in FIG. 1, is supported in its expanded orientation on sand covered beach 12. Naturally occurring sand 14, or other ungraded local aggregate, is disposed in the cells 16 of sand grid 10. An hardenable coating 18, which preferably consists of asphalt, is applied to the upper surface of sand grid 10. Coating 18 may be disposed over the edges of grid 10. Coating 18 thereby provides a hardened support surface suitable for being traveled on by vehicle 20. Mobile vehicle 20 is shown disposed on hardened coating 18 and is adapted for traveling along coating 18.

Grid 10 is shown in the expanded orientation in FIG. 2. Longitudinally extending constant height flexible resilient strips 22 and 24 are interconnected at predetermined intervals to form grid 10. Strip 22 includes a first heightwise surface 26 and a second paralalel surface 28. Second strip 24 similarly includes a first surface 30 and a second substantially parallel surface 32. Strips 22 and 24 are each substantially identical.

Each of the strips 22 and 24 are integrally bonded together at spaced weld points 34 and 36, as best shown in FIG. 2. First surface 30 of strip 24 is integrally bonded at predetermined intervals by ultrasonic welding or the like to second surface 28 of strip 22 to thereby provided weld points 34. Similarly, first surface 26 of strip 22 is integrally bonded at predetermined intervals by ultrasonic welding or the like to second surface 32 of strip 24 in order to provide weld point 36. It can be appreciated from FIG. 2 that weld points 34 and 36 are disposed over periodic intervals along strips 22 and 24 in order that the grid 10 may be disposed in a collapsed orientation, as best shown in FIG. 3, or disposed in an expanded orientation as best shown in FIG. 2. Additionally, the spacing of weld points 34 and 36 permits the cells 16 to assume a substantially double-bell configuration due to the sinusoidal configuration which the strips 22 and 24 attain when in the expanded configuration. Strips 22 and 24 are welded together over preferably their entire height, as best shown in FIG. 4.

Sand grid 10 is shown in FIG. 3 partially in the collapsed orientation and with the grid 10 in the process of being displaced into the expanded orientation. It can be noted in FIG. 3 that the strips 22 and 24 when in the collapsed orientation are generally linearly aligned and contiguous with the effect that first surface 26 of strip 22 is parallel and contiguous to second surface 32 of strip 24. In this way, the sand grid 10 in the collapsed orientation occupies relatively little space or volume and thereby permits maximum utilization of the available cargo space of the transporting medium.

The strips 22 and 24 are preferably each 6 to 8 inches in height and have a length of up to 132 inches. It is preferred that each of the strips 22 and 24 have the same constant equal height and the actual height chosen is depended upon the utilization to which the sand grid 10 is to be put. The strips 22 and 24 are preferably, manufactured from high density polyethylene the density of which is determined under ASTM Method 792. Althought polyethylene is preferred, one skilled in the art will appreciate that other thermoplastics such as nylon may be utilized. Preferably, the polyethylene has a density of approximately 0.0941 to 0.965 grams per cubic centimeter. The polyethylene, when high density polyethylene is utilized, preferably has a thickness of 0.050 inches although a deviation of 0.004 inches is tolerable. Medium grade density polyethylene or lower may be utilized but requires the use of a thicker polyethylene strip. Cell wall thickness may be determined by multiplyinig the modulus of elasticity in flexure by the thickness of the material. This requires that a standard first be provided by multiplying the modulus of elasticity in flexure of the high density polyethylene by the thickness of the high density polyethylene strip. From this standard the thickness required for lower density polyethylene may be determined. The polyethylene, regardless of grade, preferably includes means for preventing the degradation of the polyethylene by the ultraviolet radiation. Carbon black of approximately 1.5%–2% by weight may be utilized for accomplishing this purpose, although other compositions are known for this purpose.

Weld points 34 and 36 are, preferably, each disposed over 13 inch intervals for providing the necessary number of cells 16. Each grid 10 includes a total of sixty polyethylene strips 22 and 24, 8 inches in height by 132 inches in length, ultrasonically welded at 13 inch intervals to form a honeycomb arrangement of 561 cells 16 covering approximately 160 square feet. In this embodiment, the grid 10, when in the collapsed orientation, is approximately 3.5 inches thick. Similarly, in the expanded orientation, each cell 16 has a surface area of approximately 40 square inches. Furthermore, it is preferred that the welds 34 and 36 have a tensile strength of approximately 150 pounds to prevent the separation of strips 22 and 24.

Sand grid 10 is shown in cross-section in FIG. 4 with the asphalt coating 18 penetrating a substantial distance into the sand 14 filling each of the cells 16. In this way, the sand grid 10 and the hardened coating 18 will not only stabilize the beach 12 but will also permit trafficking on coating 18 of motor vehicles of up to 53,000 pounds. Although asphalt is preferred for coating 18, other hardenable liquid materials are known for this purpose. FIG. 1 discloses that clamps 38 may be used to interconnect adjacent grid sections 10 to more accurately align those sections. Utilization of clamps 38 is not required for practice of the invention because selective filling of cells 16 permits the ready alignment of adjacent grids 10.

Figure 6:
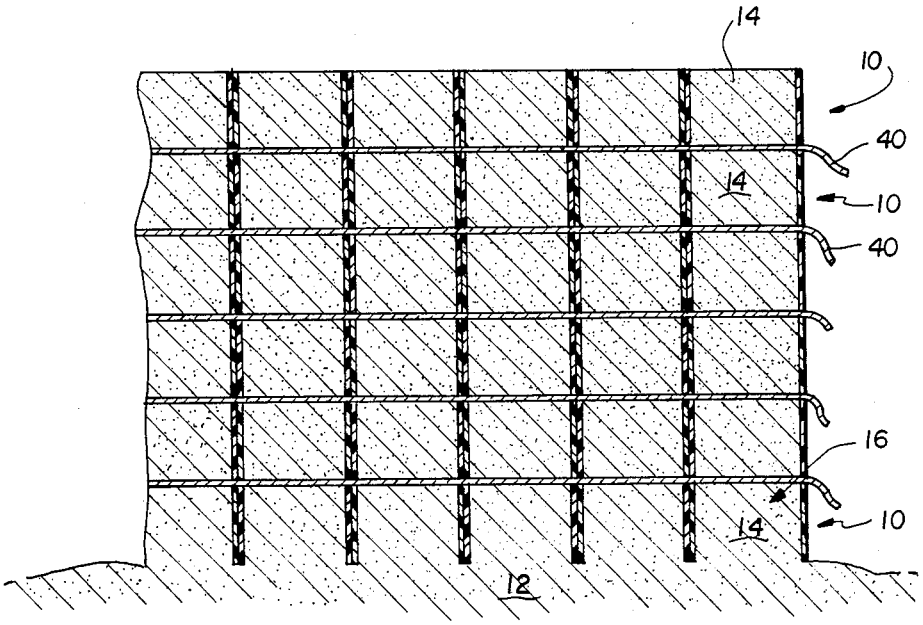

As best shown in FIGS. 5 and 6, a plurality of grids 10 may be stacked one upon the other to thereby form walls or revetments. Preferably a cloth layer separates stacked filled sand grids 10. The cloth layer 40 includes a filter cloth to prevent the shifting of sand 14 downwardly and thereby preserves the integrity of revetment 42 disposed on beach 12.

Assembly of the sand grids 10 whether in the roadway configuration, as best shown in FIG. 1–4, or in the revetment configuration, as best shown in FIGS. 5–6, may be readily accomplished without the need for excessive amounts of mechanized equipment. Sand grid 10 in the collapsed orientation, as best shown in FIG. 3, is transported from the shipping medium (not shown) to beach 12. Due to the density of the strips 22 and 24, each of the sand grids 10 has a weight of approximately 105 pounds and handling by mechanized equipment is not necessary therefore. Lower edge 44 of joined strips 22 and 24 is supported or deposited on the surfce of beach 12. End strip 46, which is either one of strips 22 and 24, is held stationary and the opposite end strip is then pulled on until the grid 10 assumes the expanded orientation. In the expanded orientation, such as in FIG. 2, each of the cells 16 has a width or a diameter 48 which is substantially equal to the height of the strips 22 and 24. The height of strips 22 and 24 is defined by parallel lower edge 44 and upper edge 48. The cells 16 are then filled with sand 14 or other naturally occurring ungraded aggregate in order to support strips 22 and 24 in the upstanding position. The sand 14 is leveled with edge 48 and wet with water. Said filled cells 16 may be compacted, preferably by a vibratory compactor although the utilization of this mechanized equipment is not necessary. Asphalt coating 18 is then applied to the upper surface of said filled cells 16 of grid 10. Approximately 1 gallon of asphalt for every square yard of grid 10 is preferred. The asphalt 18, preferably, penetrates the upper surface of sand 14 to a depth of approximately 0.5–1.0 inches in order to mix with sand 14 and to provide a solid upper surface suitable for vehicle traffic. In this way, the roadway may be readily manufactured. One skilled in the art will appreciate that adjacent sections of grid 10 will be similarly assembled, preferably simultaneously, and that due to the unique configuration and construction of the grids 10, the strips 22 and 24 may be cut to size as necessary. Additionally, due to the resilient nature of strips 22 and 24, the sand grid 10 may follow the natural contour of beach 12 or other terrain and is uniquely adapted for accommodating bumps, curves, or other surface imperfections and irregularities.

The revetment 42 of FIGS. 5 and 6 is constructed in a method similar to the roadway of FIGS. 1–4. The first grid 10 is laid on beach 12 and opened into the expanded configuration. Sand 14 is deposited in the cells 16. The sand 14 is smoothed level with the upper edge 48 and cloth layer 40 is then placed upon edges 4 defining an upper surface for said filled cells 16. Second grid 10 is then constructed on top of the first grid 10 and the revetment is then built up by repitition of this process. In this way, a number of sand grids 10 may be stacked one upon the other to form revetment 42. Consequently, the sand grids 10 form a convenient and efficient means for stabilizing the underlayer 12 while also permitting a support surface and a wall or revetment 42 to be constructed thereon.

While this invention has been described as having a preferred design, it is understood that it is capable of further modifications, uses and/or adaptations without departing from the principles of the invention and including such departures as may come within known or customary practice in the art to which the invention pertains.

What I claim is:

1. A structure for providing a trafficable surface comprising:

(a) a grid comprising a plurality of interconnected, flexible upstanding strips of generally constant equal height and generally equal length, each said strip having a top edge and a bottom edge, said bottom edges of said grid strips adapted for only resting on an underlayer whereby said top edges of said grid strip and said bottom edges of said grid strips assume the contour of said underlayer;

(b) said grid having a first collapsed orientation whereby said strips are generally linearly aligned and substantially contiguous and a second expanded orientation whereby said strips are of a generally longitudinal sinusoidal configuration and form a plurality of open ended cells; and (c) each of said cells being substantially filled with a compacted, granular material, said compacted, granular material providing said trafficable surface.

2. The grid of claim 1 wherein:

(a) each of said strips includes a first and a second side surface; and (b) each said strip forming bonds at predetermined intervals along its first side surface to the second side surface of an adjacent strip.

3. The grid of claim 2 wherein said bonds are offset thereby providing said open ended cells when said grid is in said expanded orientation.

4. The grid of claim 1, wherein said strips are fabricated from polyethylene.

5. The grid of claim 4, wherein said polyethylene includes means for preventing damage by ultraviolet radiation.

6. The grid of claim 5, wherein said means for preventing damage includes carbon black.

7. The grid of claim 4, wherein said polyethylene has a density of approximately 0.941 to approximately 0.965 grams per cubic centimeter and a thickness of substantially 0.050 inches.

8. The grid of claim 4, wherein said polyethylene has a density less than 0.941 grams per cubic centimeter and a thickness exceeding 0.05 inches.

9. The grid of claim 1, wherein said grid includes approximately 60 of said strips bonded so as to provide a rectangular form when in the expanded orientation.

10. The grid of claim 1, wherein:

(a) said height being substantially equal to 8.0 inches; and (b) said length being substantially equal to said 132.0 inches.

11. The grid of claim 2, wherein said predetermined intervals for bonding said strips are substantially 13 inches.

12. The grid of claim 1, wherein said grid includes 561 cells.

13. The grid of claim 1, wherein each of said cells covers an area of said underlayer of approximately 40 square inches.

14. The grid of claim 1 further comprising an overlayer supported by said compacted, granular material for providing said trafficable surface.

15. The grid of claim 1 wherein said compacted, granular material includes sand.

16. The grid of claim 14 wherein said overlayer penetrates to a predetermined depth into said cells.

17. The grid of claim 14 wherein said overlayer is fabricated from asphalt.

18. The grid of claim 14 further comprising, at least one other expanded grid having the cells thereof filled and disposed on said overlayer for forming a barrier structure.

19. A barrier structure comprising, (a) a plurality of grids, each said grid comprising a plurality of interconnected, flexible, upstanding strips of generally constant equal height and generally constant equal length, each said strip having a top edge and a bottom edge, said grids being stacked one upon the other with the top edges of one grid adjacent the bottom edges of the adjacent overlaying grid and the bottom edges of a bottom grid only resting on an underlayer;

(b) each said grid having a first collapsed orientation whereby said strips are generally linearly aligned and substantially contiguous and a second expanded orientation whereby said strips are of a generally longitudinal sinusoidal configuration and form a plurality of open ended cells;

(c) each of said grid cells being substantially filled with a compacted, granular material, said compacted, granular material forming a support surface for each said grid.

20. The barrier structure of claim 19 further including a plurality of overlayers, one each disposed between said adjacent grids and supported by said compacted, granular material.

21. The barrier structure of claim 19 wherein said compacted, granular material includes sand.

22. The barrier structure of claim 20 further comprising a top overlayer overlaying the top edges of the uppermost grid and supported by said compacted, granular material.

23. The barrier structure of claim 22 wherein said top overlayer penetrates to a predetermined depth into said cells.

24. The barrier structure of claim 22 wherein said top overlayer is fabricated from asphalt.

25. The barrier structure of claim 20 wherein each said overlayer penetrates to a predetermined depth into said cells.

26. The barrier structure of claim 20 wherein each said overlayer is fabricated from asphalt.

27. The barrier structure of claim 19 wherein said strips are fabricated from polyethylene.

28. The barrier struction of claim 27 wherein said polyethylene includes means for preventing damage by ultraviolet radiation.

29. The barrier structure of claim 28 wherein said means for preventing damage includes carbon black.

30. The barrier structure of claim 27 wherein said polyethylene has a density of approximately 0.941 to approximately 0.965 grams per cubic centimeters and a thickness of substantially 0.050 inches.

31. The barrier structure of claim 27 wherein said polyethylene has a density less than 0.941 grams per cubic centimeters and a thickness exceeding 0.05 inches.

32. The grid of claim 14 wherein said overlayer includes a hardened layer.

33. A method of stabilizing an underlayer and providing a support surface, comprising the steps (a) providing a first expandable grid comprised of a plurality of interconnected flexible strips, said grid having a first collapsed orientation whereby said strips are generally linearly aligned and contiguous and a second expanded orientation whereby said strips provide a number of open ended cells;

(b) supporting said grid in said collapsed orientation only on said underlayer;

(c) expanding said grid to said expanded orientation for thereby providing said number of open ended cells whereby said grid assumes the contour of said underlayer;

(d) substantially filling each of said cells with a granular material; and (e) compacting said granular material to form compacted granular material said compacted, granular material providing said support surface.

34. The method of claim 33 including the further step of providing an overlayer on said first grid supported by said compacted, granular material.

35. The method of claim 33 including the further steps of:

(a) applying a hardenable material to said grid over said grid surface, said material adapted for penetrating said filled cells to a predetermined depth and being supported by said compacted, granular material.

(b) hardening said hardenable material.

36. The method of claim 33 including the further steps of:

(a) providing a second expandable grid comprised of a plurality of interconnected flexible strips, said second grid having a first collapsed orientation whereby said strips are generally linearly aligned and contiguous and a second expanded orientation, whereby said strips provide a number of open ended cells;

(b) supporting said second grid in said collapsed orientation on said overlayer;

(c) expanding said second grid to said expanded orientation for thereby providing said number of open ended overlayer;

(d) substantially filling each of said cells with a compacted, granular material, said compacted, granular material providing a support surface; and (e) providing an overlayer on said second grid supported by said compacted, granular material.

37. The method of claim 35 including the further step of repeating steps (a)-(e) of claim 60 until a desired number of grids are stacked one on top of the other.

38. The method of claim 36 wherein step (e) of claim 60 is omitted for the top grid.

39. A structure for providing a trafficable surface comprising:

(a) a plurality of interconnected upstanding strips of flexible material having generally constant equal height and generally equal length, said strips assuming the contour of and only being supported by an underlayer;

(b) said interconnected strips forming a plurality of open ended cells; and (c) each of said cells being substantially filled with a compacted generally granular material for providing said trafficable surface.

40. The structure of claim 39 wherein:

(a) each of said strips includes a first and a second side surface (b) each said strip forming bonds at predetermined intervals along its first side surface to the second side surface of an adjacent strip; and (c) said bonds being offset thereby providing said open ended cells when said grid is in said expanded orientation.

41. The structure of claim 39, wherein said material is polyethylene.

42. The structure of claim 41 wherein said polyethylene includes means for preventing damage by ultraviolet radiation.

43. The structure of claim 42, wherein said means for preventing damage includes carbon black.

44. The structure of claim 41, wherein said polyethylene has a density of approximately 0.941 to approximately 0.965 grams per cubic centimeter and a thickness of substantially 0.050 inches.

45. The structure of claim 41, wherein said polyethylene has a density less than 0.941 grams per cubic centimeter and a thickness exceeding 0.05 inches.

46. The structure of claim 39, wherein said grid includes about 50 of said strips bonded so as to provide a rectangular form when in the expanded orientation.

47. The structure of claim 39, wherein:

(a) said height being substantially equal to 8.0 inches; and, (b) said length being substantially equal to said 132.0 inches.

48. The structure of claim 47, wherein said predetermined intervals for bonding each of said one and said another one strips being substantially 13 inches.

49. The structure of claim 48, wherein said grid includes 561 cells.

50. The structure of claim 39, wherein each of said cells covers an area of said underlayer of approximately 40 square inches.

51. The structure of claim 39 wherein:

(a) each of strips includes an upper edge and a lower edge; and (b) an overlayer disposed on said upper edges of said strips, 52. The structure of claim 51, wherein said overlayer includes a hardened layer.

53. The structure of claim 52, wherein said overlayer penetrates to a predetermined depth into said cells.

54. The structure of claim 51, wherein said overlayer penetrates to a predetermined depth into said cells.

55. The structure of claim 54 wherein said hardened layer is asphalt.

56. The barrier structure of claim 19 further comprising a plurality of means for preventing the passage of said compacted, granular material from said overlaying filled grids to said underlying filled grids.

57. The barrier structure of claim 20 wherein each said means for preventing the passage of said compacted granular material from said overlaying filled grids to said underlying filled grids includes a filter material.

58. The barrier structure of claim 56 wherein said means for preventing the passage of said compacted granular material from said overlaying filled grids to said underlying filled grids comprises a cloth layer.

59. The barrier structure of claim 58 wherein said cloth layer includes a filter cloth.

* * * * *